US006699002B2

(12) United States Patent
Kinoshita

(10) Patent No.: US 6,699,002 B2
(45) Date of Patent: Mar. 2, 2004

(54) TELESCOPIC LIFTING VEHICLE

(75) Inventor: Yukio Kinoshita, Tsurugashima (JP)

(73) Assignee: Komatsu Utility Europe S.p.A., Noventa Vicentina (IT)

( * ) Notice: Subject to any disclaimer, the term of this patent is extended or adjusted under 35 U.S.C. 154(b) by 0 days.

(21) Appl. No.: 10/158,859

(22) Filed: Jun. 3, 2002

(65) Prior Publication Data

US 2003/0215321 A1 Nov. 20, 2003

(30) Foreign Application Priority Data

May 15, 2002 (EP) ..... 02425305

(51) Int. Cl.[7] ..... B66C 23/04
(52) U.S. Cl. ..... 414/728; 280/764.1
(58) Field of Search ..... 414/728, 685, 414/680; 280/764.1, 765.1

(56) References Cited

U.S. PATENT DOCUMENTS 4,266,909 A * 5/1981 Langenfeld et al. ..... 414/700
4,515,520 A * 5/1985 Parquet et al. ..... 280/765.1 X
5,199,861 A 4/1993 Merlo et al.
5,727,921 A * 3/1998 Brown ..... 414/680 X
5,836,733 A * 11/1998 Moses et al. ..... 414/685
5,964,567 A * 10/1999 Bamford ..... 414/685
6,390,764 B1 * 5/2002 Merlo et al. ..... 414/680

FOREIGN PATENT DOCUMENTS

DE 27 39 537 3/1978

* cited by examiner

*Primary Examiner*—Donald W. Underwood
(74) *Attorney, Agent, or Firm*—Browdy and Neimark

(57) ABSTRACT

Telescopic lifting vehicle comprising a support frame having a central longitudinal axis of development at the two sides whereof are mounted a control cab and an engine. The engine and the cab identify between them a housing open superiorly and developing along the central longitudinal axis of the vehicle. The vehicle is also provided with a telescopic arm pivotally engaged to a rear portion of the frame, able to be inserted at least partially in the housing, and having an operative end able to be associated to an operative organ. A lifting cylinder, positioned below the telescopic arm, allows the actuation of the telescopic arm, and can be inserted into a vertical opening obtained in correspondence with at least a part of the housing, when the telescopic arm is inserted in the housing itself.

15 Claims, 7 Drawing Sheets

TELESCOPIC LIFTING VEHICLE

BACKGROUND OF THE INVENTION

The present invention relates to a telescopic lifting vehicle.

For many years, telescopic lifting vehicles have been constructed with a central telescopic arm, at the two sides whereof are mounted at one side the driver's cab and at the other the engine (as described, for example, in the Patent DE 2 739 537).

The evolution of telescopic lifts has then led, over the years, to several improvements of their constructive structure, in order to improve on one hand the stability of the vehicle when lifting loads, on the other the visibility of the operator sitting in the cab.

In fact, whilst several years ago the telescopic arm was pivotally engaged to the frame of the vehicle in a rear raised position, and developed to a height corresponding to, if not even greater than, that of the cab window, currently, as described for example in U.S. Pat. No. 5,199,861, the arm is positioned substantially below the cab window, in an appropriate housing obtained on the frame, between the base of the cab and the engine of the vehicle.

In accordance with the art illustrated in U.S. Pat. No. 5,199,861, to enable keeping the telescopic arm below the cab, its lifting cylinder is positioned laterally between it and the cab. In this way, however, drawbacks are encountered in terms of lateral size.

Another characteristic that hampers the lowered positioning of the telescopic arm, in currently used lifting vehicles, consists of the shape of the frontal stabilisers of the vehicle, and in particular in the shape of the frame whereto the stabiliser feet are associated.

Said frame has a latching portion fastened to the frame of the vehicle, and a support portion bearing the feet. In known manners, the latching portion has a substantially rectangular coupling surface able to be fastened to the front portion of the vehicle frame, below the telescopic arm (FIGS. 5 through 7).

The presence of the latching portion thus constitutes a limit for the lowering of the arm relative to the vehicle.

SUMMARY OF THE INVENTION

In this situation the technical task constituting the basis for the present invention is to obtain a telescopic lifting vehicle that overcomes the aforementioned drawbacks.

In particular a technical task of the present invention is to obtain a telescopic lifting vehicle that assures an excellent visibility to the operator sitting in the cab, whilst keeping the centre of gravity of the vehicle lower than in traditional vehicles.

The specified technical task and the indicated aims are substantially achieved by a telescopic lifting vehicle, as described in the accompanying claims.

BRIEF DESCRIPTION OF THE DRAWINGS

Further features and advantages of the invention shall become more readily apparent from the detailed description that follows of some preferred, but not exclusive, embodiments of a telescopic lifting vehicle, illustrated in the accompanying drawings, in which.

DESCRIPTION OF THE PREFERRED EMBODIMENT

Figure 1:
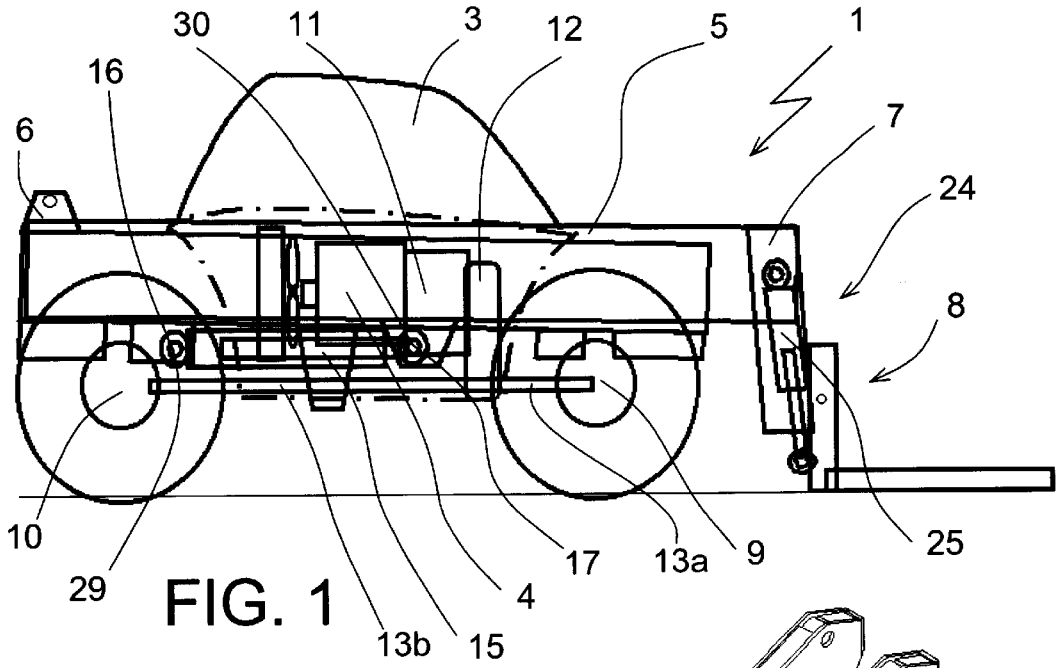
FIG. 1 shows a schematic lateral view, with some parts removed and others shown in see-through fashion, of a telescopic lifting vehicle according to the present invention.
Figure 11:
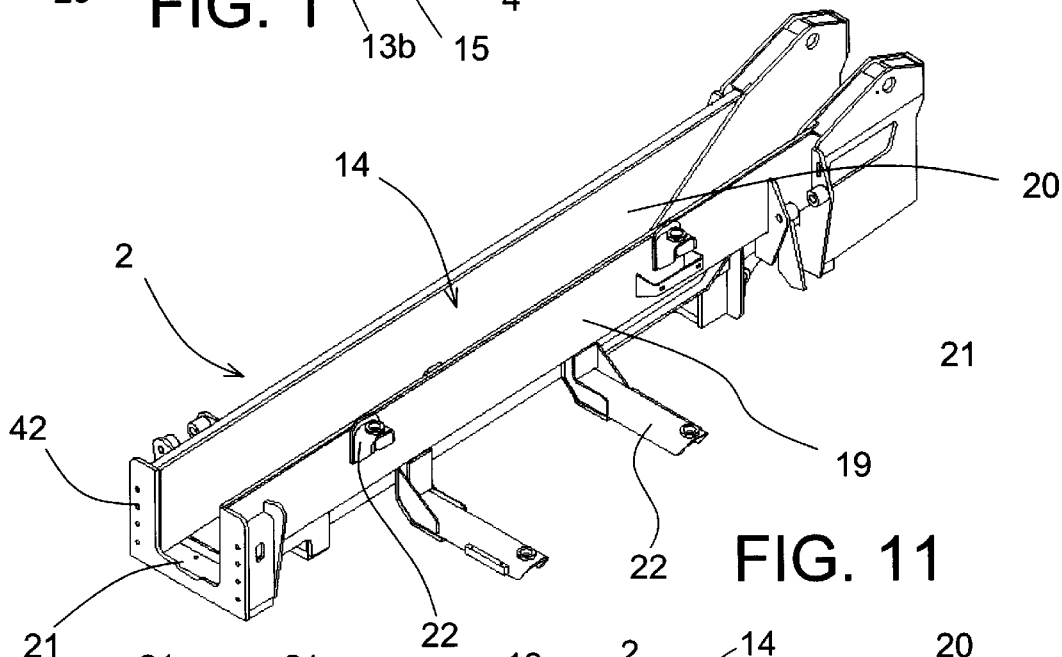
FIG. 11 shows an axonometric three-quarters view of the frame of a telescopic lifting vehicle according to the present invention.
Figure 12:
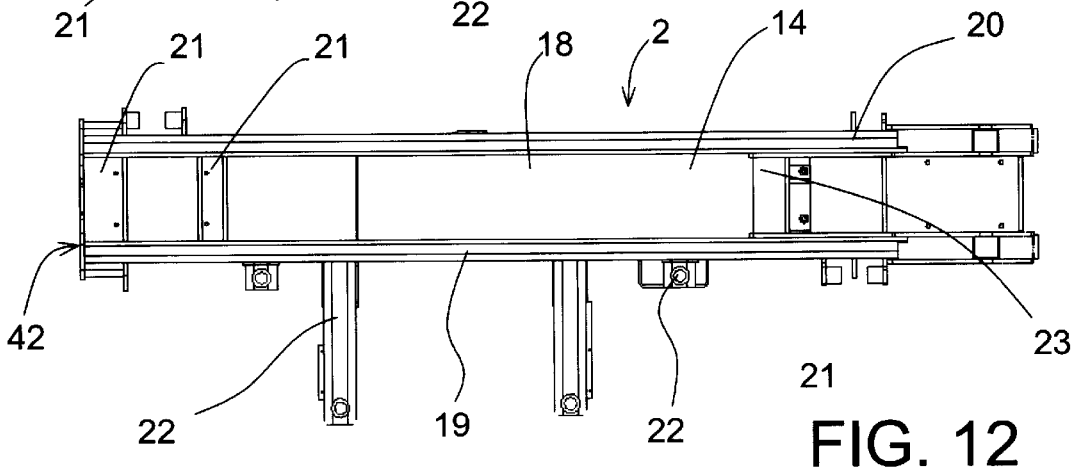
FIG. 12 shows a plan view of the frame of FIG. 11.
Figure 2:
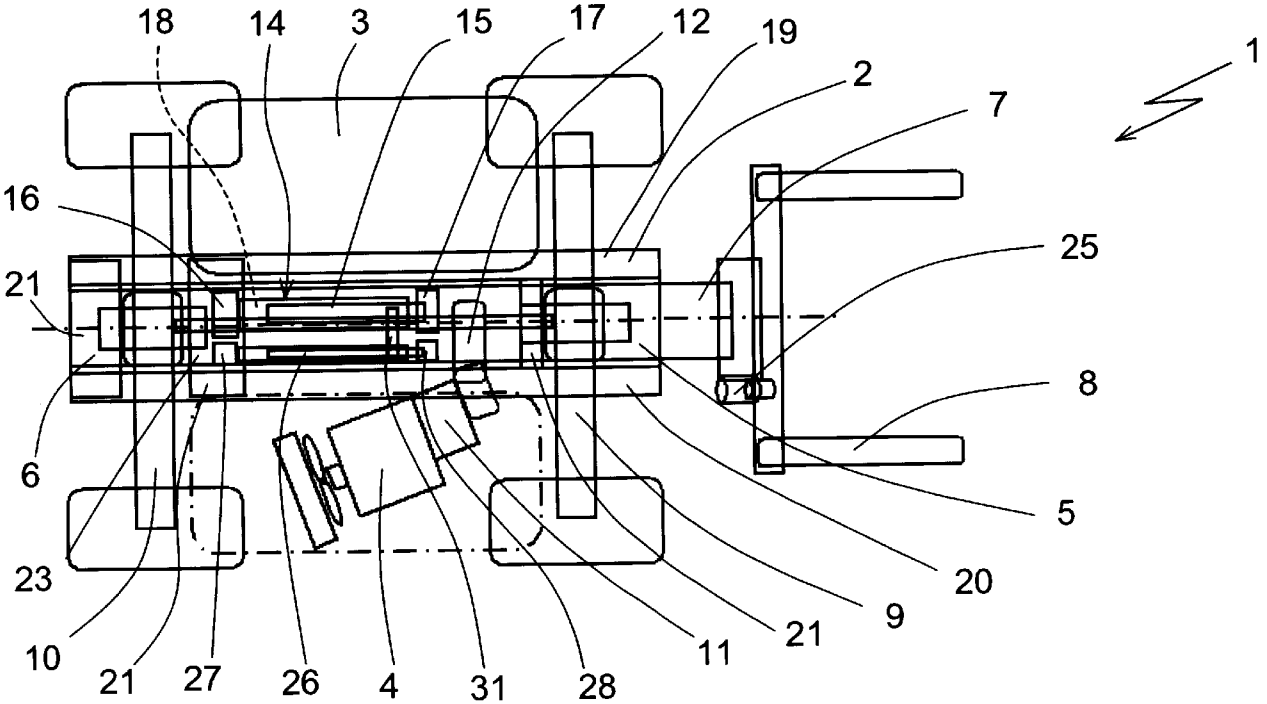
FIG. 2 shows a schematic plan view, with some parts removed and others shown in see-through fashion, of the telescopic lifting vehicle of FIG. 1.
Figure 3:
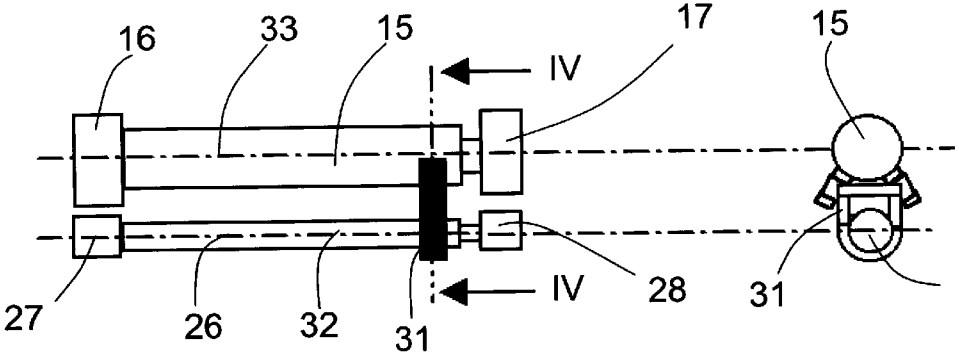
FIG. 3 shows a detail of the vehicle of FIG. 2.
Figure 4:
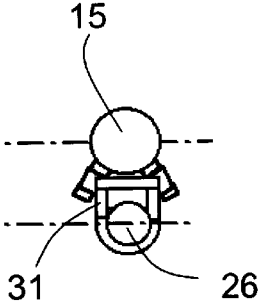
FIG. 4 shows a front sectioned view of the detail of FIG. 3 according to trace IV—IV.

With reference to the aforementioned figures, the reference number 1 globally indicates a telescopic lifting vehicle, according to the present invention.

The lifting vehicle 1 is constituted by a support frame 2 having a central longitudinal axis of development, at the sides whereof are mounted on one side a control cab 3, on the other an engine 4 for powering the vehicle 1.

On the frame 2 is also mounted a telescopic arm 5 having its base portion 6 pivotally engaged to a rear portion of the frame 2 itself, according to a horizontal axis perpendicular to the longitudinal axis. The arm 5 further has an operative extremity 7 able to be associated to an operative tool 8, such as a lifting fork as shown in the accompanying figures.

The vehicle 1 is further provided with a front axle 9 and with a rear axle 10 provided with wheels. Between the engine 4, which in the preferred embodiment has its own axis positioned horizontally and inclined towards the front part of the longitudinal axis of the vehicle 1, and each of the two axles 9, 10, are further connected, in this order, a transmission 11, a transfer case 12 and a drive shaft 13 developing horizontally under the frame 2.

As shown for example in FIGS. 1, 15, 16 and 19, the drive shaft 13 is formed by two portions 13*a* (front portion) and 13*b* (rear portion) both connected to the transfer case 12.

The frame 2, between the engine 4 and the cab 3, has a housing 14 open superiorly and developing over the entire length of the vehicle 1 along the longitudinal central axis, inside which can be inserted, at least partially, the telescopic arm 5, when it is in non operative position.

Figure 18:
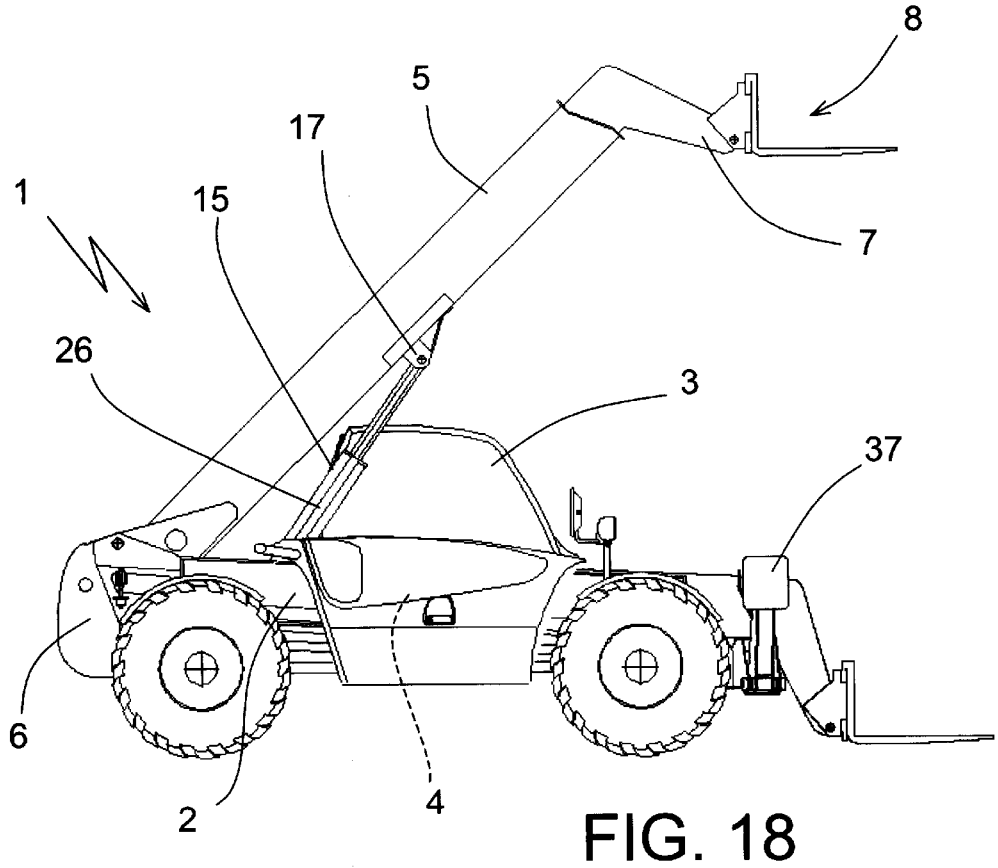
FIG. 18 shows a lateral elevation view of vehicle of FIG. 13 with the telescopic arm in raised position.
Figure 19:
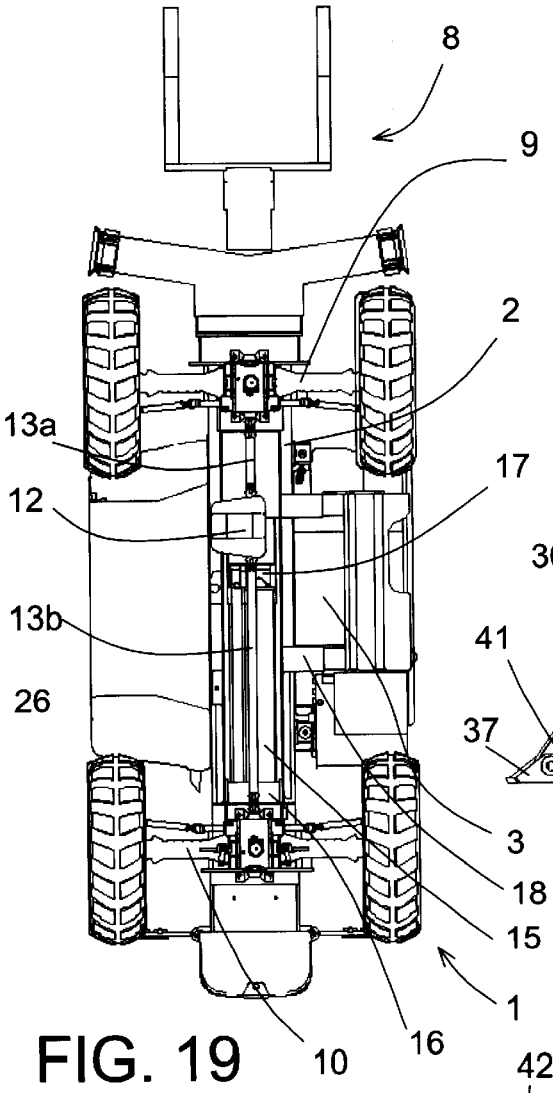
FIG. 19 shows a bottom view of the vehicle of FIG. 13.

The arm 5 is movable between the non operative position and an operative position in which it is inclined upwards (FIGS. 16 and 18) through a lifting cylinder 15 which has a first end 16 pivotally engaged to the frame 2 and a second end 17 pivotally engaged to the telescopic arm 5, and which is positioned below the telescopic arm 5 itself.

In regard to the frame 2, it has a vertical opening 18 in correspondence with at least a part of the housing 14, opening 18 in which the lifting cylinder 15 is inserted when the telescopic arm 5 is recessed in the housing 14. In this circumstance the lifting cylinder 15 is located substantially below the frame 2.

As is also shown in the accompanying figures, the lifting cylinder 15 is preferably positioned in front of the rear axle 10, behind the transfer case 12, above the drive shaft 13 and below the frame 2.

In the preferred embodiment the frame 2 is constituted by two lateral bodies 19, 20, each defining a lateral wall of the housing 14, and identifiable as a first body 19 positioned on the side of the cab 3 and a second body 20 positioned on the side of the engine 4, connected to a plurality of brackets 21 having horizontal development, transverse to the longitudinal axis of the vehicle 1, and positioned below the housing 14.

From the first body 19 develop some shelves 22 for supporting the cab 3, whilst the engine 4 is connected directly to the second body 20.

Each axle 9, 10 is supported by a pair of brackets 21, positioned one in front and one behind it.

Moreover, the first end 16 of the lifting cylinder 15 is pivotally engaged to one of the brackets 21 supporting the rear axle 10, specifically to the front bracket 23.

The telescopic lifting vehicle 1 further comprises means 24 for leveling the operative tool 8 to maintain the operative tool 8 parallel to itself during the motions of the arm 5, means which are constituted by a leveling cylinder 25 fastened to the operative end 7 of the arm 5, and by a compensating cylinder 26 hydraulically connected to the leveling cylinder 25.

The compensation cylinder 26 has a primary end 27 pivotally engaged to the frame 2 and a secondary end 28 pivotally engaged to the telescopic arm 5, and it is positioned parallel and horizontally coplanar to the lifting cylinder 15 below the telescopic arm 5, in such a way as to be also inserted in the opening 18 when the arm 5 is inserted in the housing 14.

In particular, the compensating cylinder 26 has a length equal to that of the lifting cylinder 15, so that the first end 16 of the lifting cylinder 15 and the primary end 27 of the compensating cylinder 26 are pivotally engaged to the frame 2 by means of a single first pivot pin 29, and, similarly, in such a way that the second end 17 of the lifting cylinder 15 and the secondary end 28 of the compensating cylinder are pivotally engaged to the frame 2 by means of a single second pivot pin 30.

Each pivot pin 29, 30 is inserted through two forks set side by side, fastened to the frame 2, having a central tine in common, and destined one to the lifting cylinder 15 and one to the compensating cylinder 26.

Additionally, there can also be a connecting element 31 of the jacket 32 of the compensating cylinder 26 to the jacket 33 of the lifting cylinder 15 in order to sustain the compensating cylinder 26 when the telescopic arm 5 is raised, preventing the occurrence of deformations to the compensating cylinder 26 itself, due to the disparity between the length and the diameter of the cylinder when it is extended, and at the high pressures that can be created therein, under certain load conditions.

Figure 8:
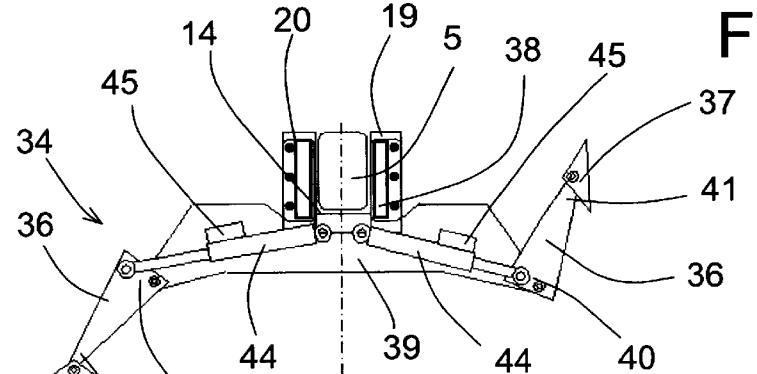
FIG. 8 shows a front view of the detail of FIG. 5 according to the present invention.
Figure 9:
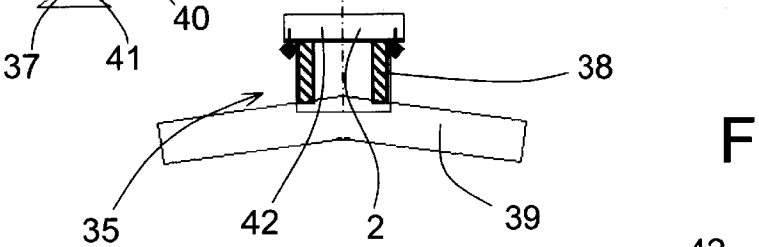
FIG. 9 shows a schematic partial plan view of the detail of FIG. 8.
Figure 10:
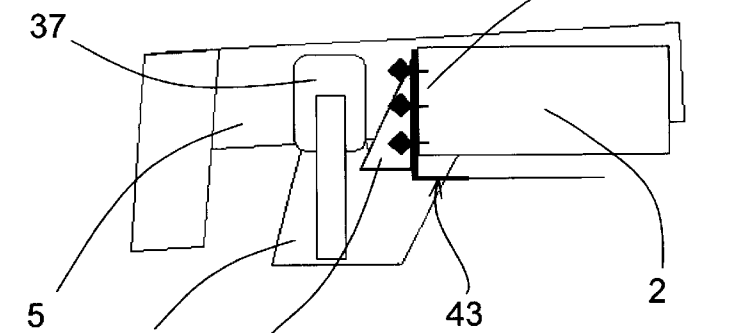
FIG. 10 shows a schematic partial lateral view of the detail of FIG. 8.

The telescopic lifting vehicle 1 is also provided with stabilisation means 34 mounted anteriorly to the frame 2, and constituted by a structure 35 bearing two legs 36 each provided with a stabiliser foot 37. The structure 35 comprises a portion 38 for latching to the frame 2 and a portion 39 for supporting the legs 36 which extends transversely relative to the vehicle 1. As shown in FIG. 8, the support portion 39 has an arcuate shape going partially around the telescopic arm 5.

The legs 36 are positioned at the lateral ends of the support portion 39 and have each an inner end 40 pivotally engaged to the support portion 39, and an outer end 41 bearing the stabiliser foot 37.

Each leg 36 can be actuated between a locked position in which the foot 37 is set down on the ground, and a manoeuvring position in which the foot 37 is raised off the ground.

The latching portion 38 is associated to a front portion 42 of the frame 2 whilst the supporting portion 39 is integrally connected with the latching portion 38 in its own intermediate portion.

When the telescopic arm 5 is inserted in the housing 14, the supporting portion 39 is below it.

The latching portion 38 instead is associated to the frame 2 at the two sides of the housing 14, and has, in correspondence with the related areas of coupling to the frame 2, a U shape with a side of the U fastened to the first lateral body 19 and the other side of the U fastened to the second lateral body 20.

Figure 21:
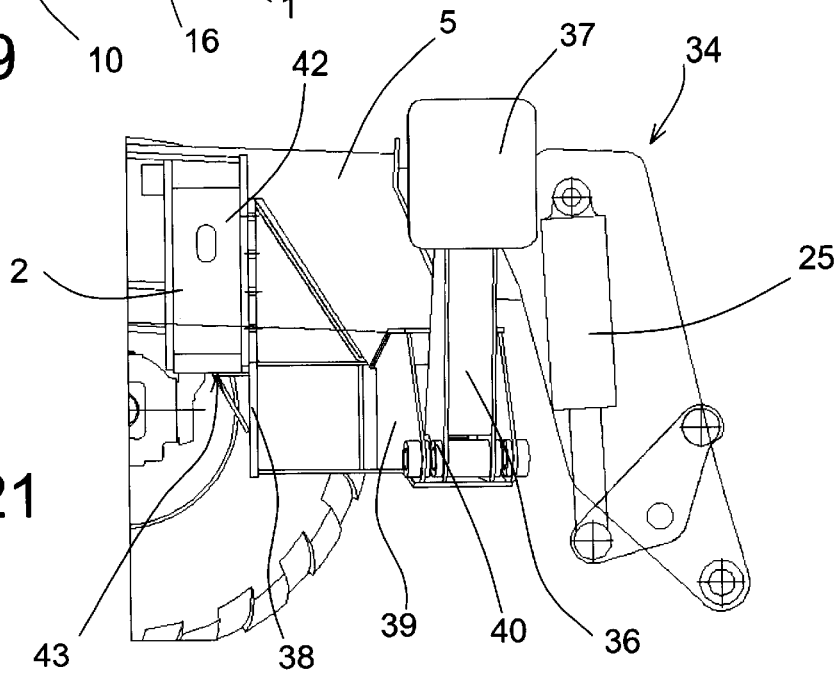
FIG. 21 shows a lateral elevation view of the detail of the stabilisers of the vehicle FIG. 15.

The latching portion 38 also has a second surface 43 able to be associated to the frame 2 below its front portion 42 (FIG. 21).

Figure 20:
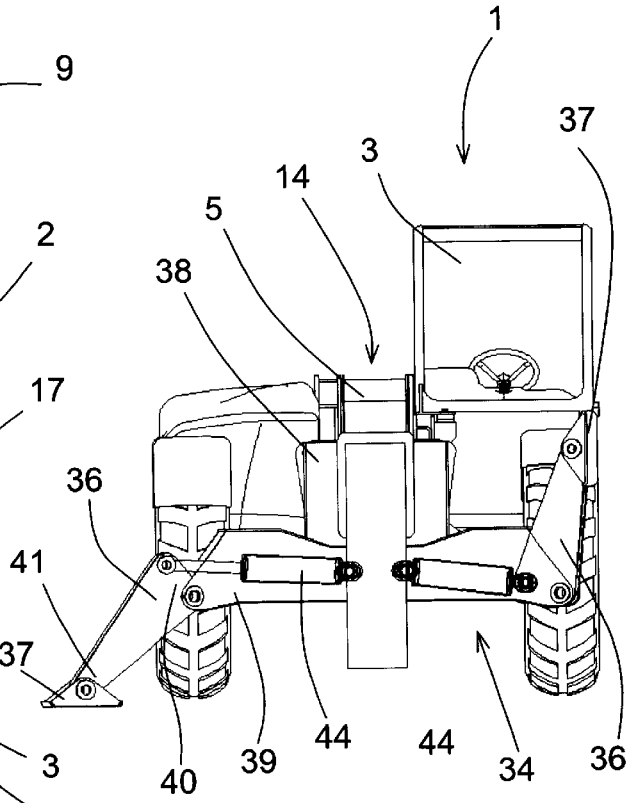
FIG. 20 shows a front view of the vehicle of FIG. 15 with the stabiliser feet in the two possible positions.

As shown in FIGS. 20 and 21, when the feet 37 are in the manoeuvring position and the arm 5 is inserted in the housing 14, the arm 5 is positioned at a height not exceeding that of the stabiliser feet 37.

The actuation of each leg 36 is performed by a hydraulic actuating cylinder 44 having its jacket and piston associated one below the telescopic arm 5 to the support portion 39 of the structure 35, the other one to the leg 36. The hydraulic cylinders are fed by means of a feed valve 45 associated to each cylinder 44 in correspondence with its area close to the leg 36, in such a way as not to be a hindrance for the arm 5 (FIG. 8).

The operation of the vehicle 1 of the present invention takes place in ways similar to those of traditional telescopic lifters, and directly deducible from the description made heretofore of the vehicle 1 itself.

The present invention achieves important advantages, since, for the same free height from the ground and the same dimensions of the arm and of the cab, a vehicle in accordance with the present invention has a lower centre of gravity than do vehicles in accordance with the prior art, whilst also assuring an excellent visibility to the operator sitting in the cab.

Figure 5:
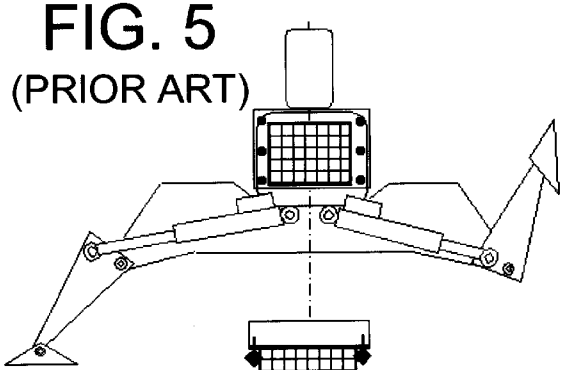
FIG. 5 (PRIOR ART)
FIG. 5 shows a front schematic view of a detail of a telescopic lifting vehicle according to the prior art.
Figure 6:
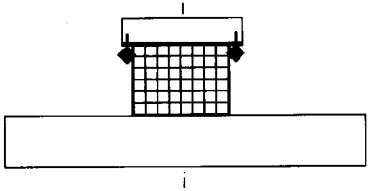
FIG. 6 (PRIOR ART)
FIG. 6 shows a schematic partial plan view of the detail of FIG. 5.
Figure 7:
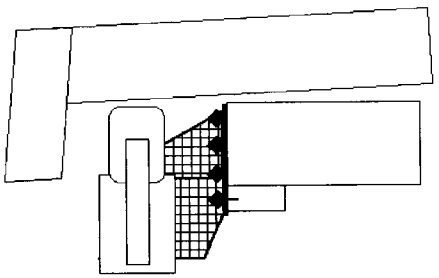
FIG. 7 (PRIOR ART)
FIG. 7 shows a schematic partial lateral view of the detail of FIG. 5.
Figure 13:
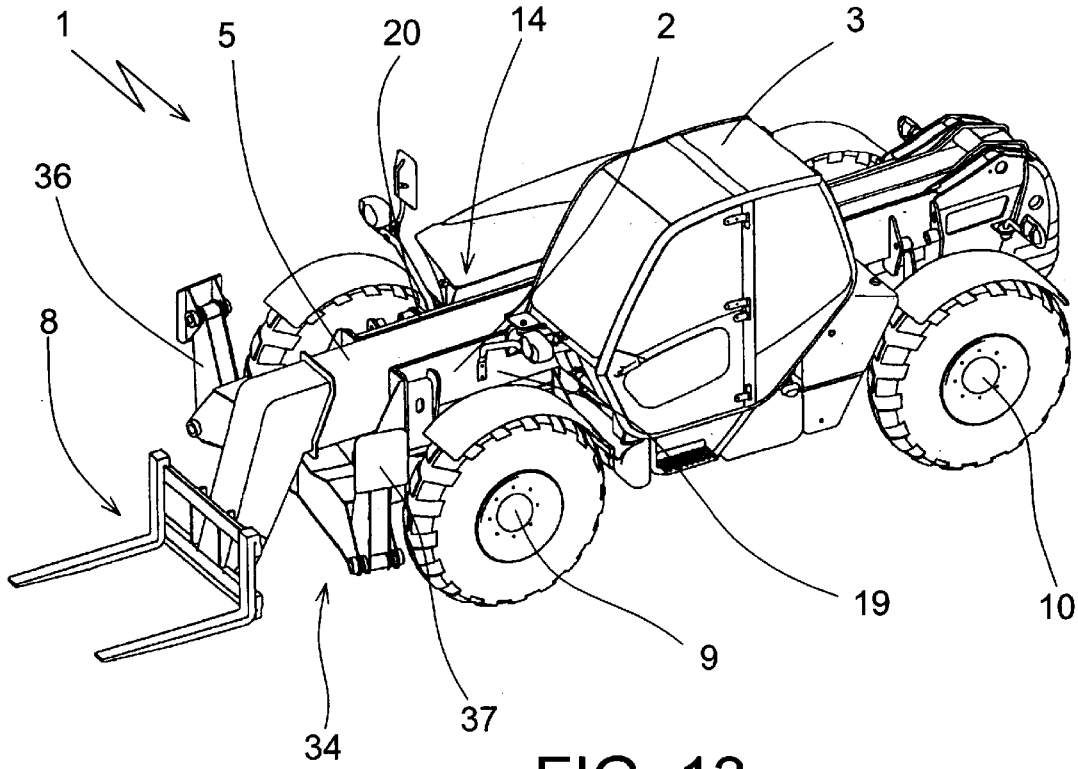
FIG. 13 shows an axonometric three-quarters view of a telescopic lifting vehicle according to the present invention.
Figure 14:
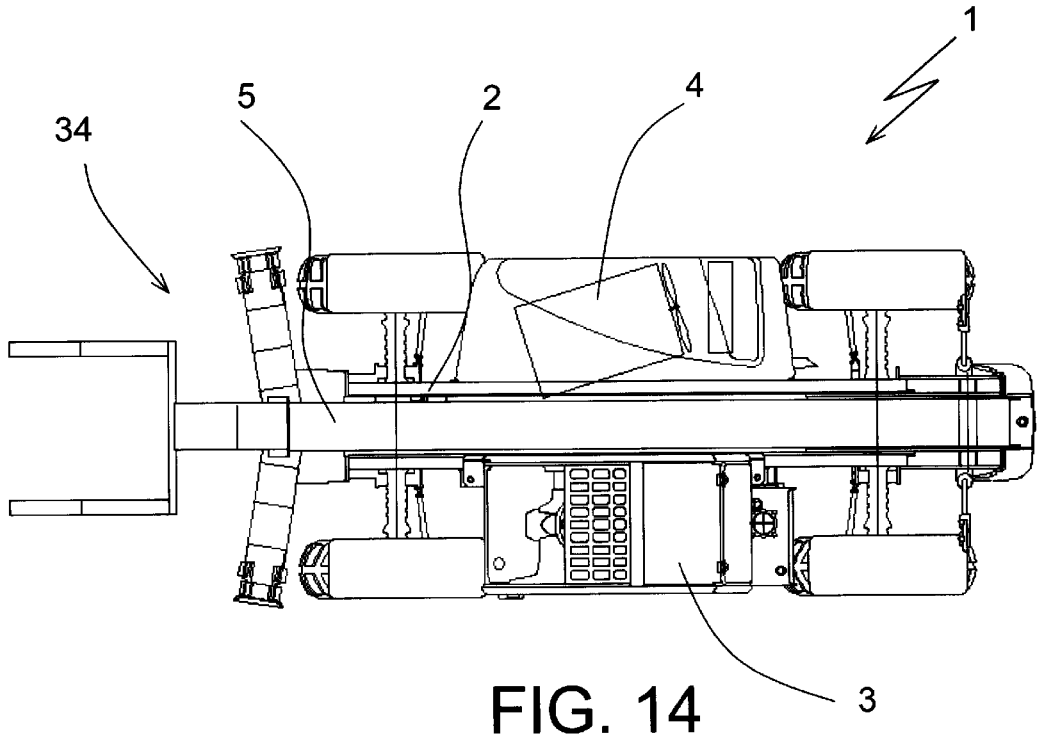
FIG. 14 shows a plan view of the vehicle of FIG. 13 with some parts removed and others shown in see-through fashion.
Figure 15:
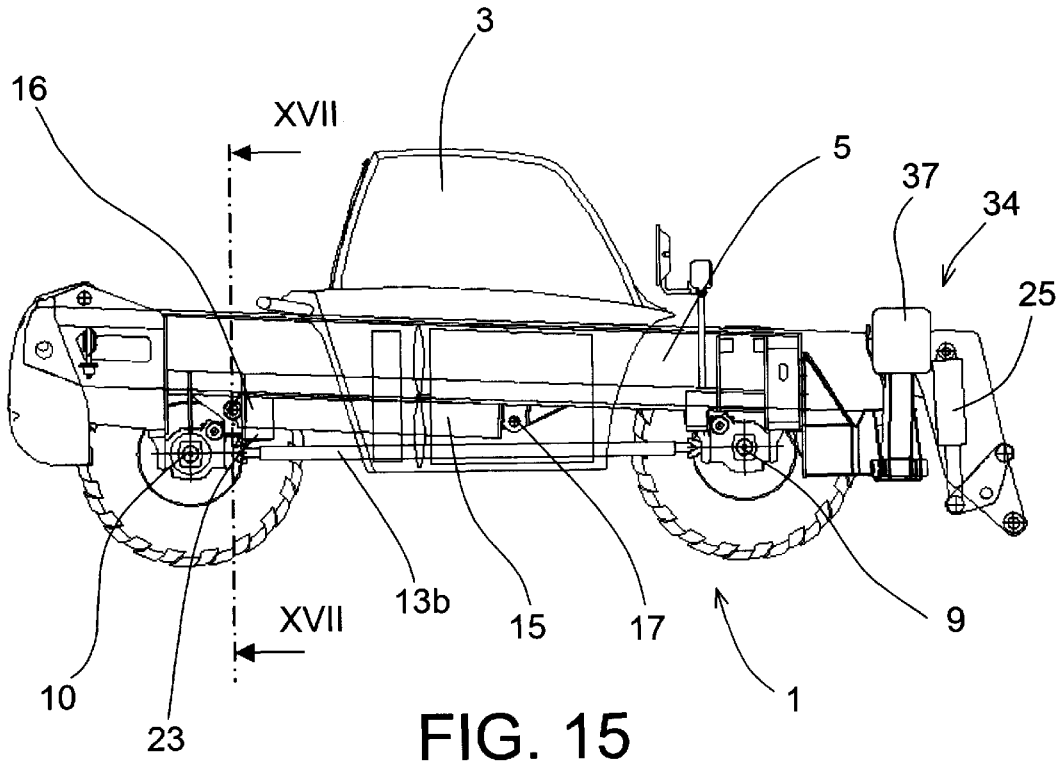
FIG. 15 shows a lateral elevation view of FIG. 13 with some parts removed and others shown in see-through fashion.
Figure 16:
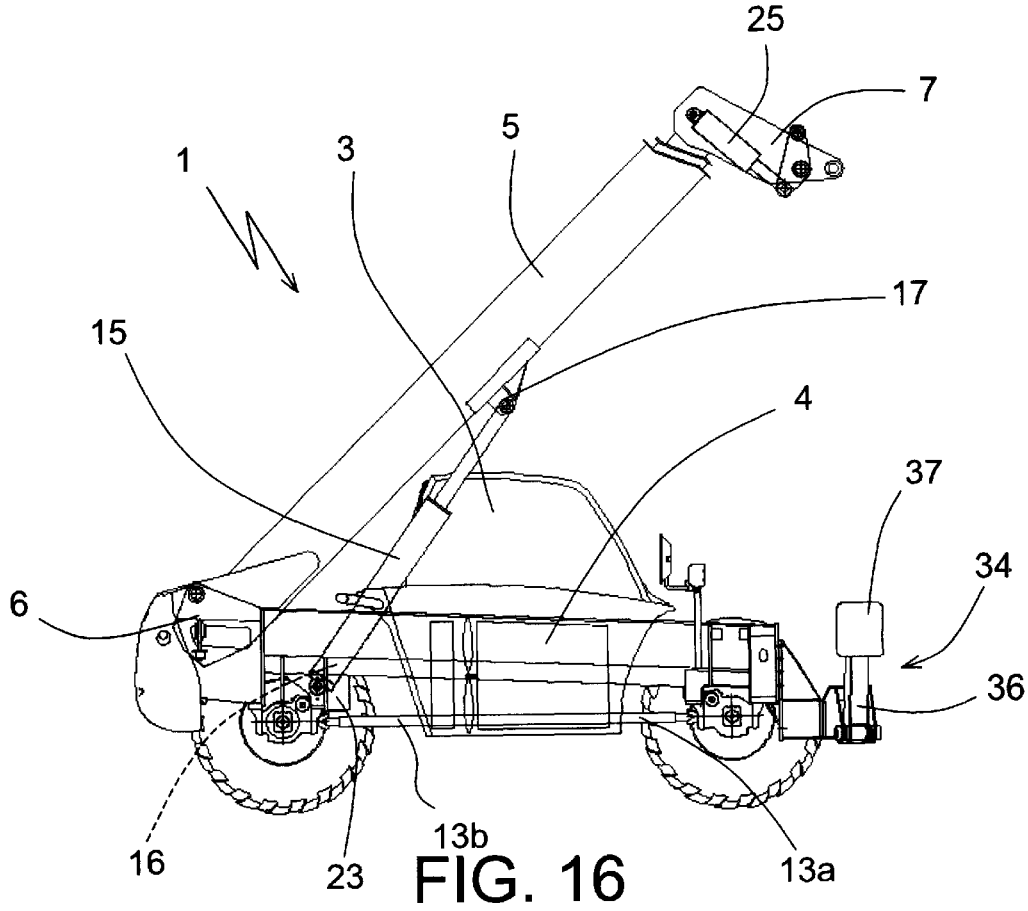
FIG. 16 shows a lateral elevation view of 15 with the telescopic arm in the raised position.
Figure 17:
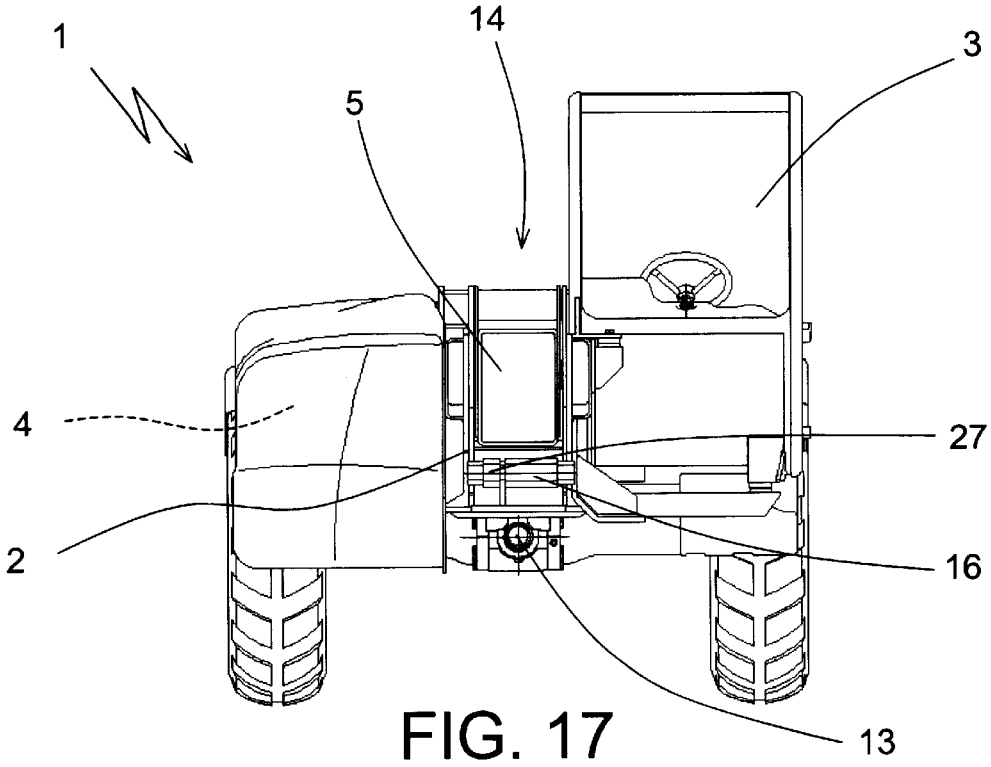
FIG. 17 shows a front view of the vehicle of FIG. 15 with the lifting arm sectioned according to trace XVII—XVII of FIG. 15.

Comparing prior art vehicles, shown in FIG. 5, with the embodiment of FIG. 8, it is evident that in the present invention the arm (and thus the centre of gravity of the vehicle) is considerably lower.

It should also be noted that the present invention is also relatively easy to realise and that the cost connected to implementing the invention is not very high.

The invention thus conceived can be subject to numerous modifications and variations, without thereby departing from the scope of the inventive concept that characterises it.

All components can be replaced by other technically equivalent elements and in practice all materials used, as well as the shapes and dimensions of the various components, can be any depending on requirements.

What is claimed is:

1. A telescopic lifting vehicle comprising:

a support frame having a central longitudinal axis of development and defining a housing accessible at least from above, and extending over the entire length of the frame along said central longitudinal axis;

a control cab mounted on the frame laterally relative to the housing;

an engine mounted on the frame on the opposite side of the housing relative to said cab;

a telescopic arm pivotally engaged to a rear portion of said frame according to a horizontal axis perpendicular to the longitudinal axis, able to be inserted at least partially in said housing, and having an operative end able to be connected to an operative tool;

said telescopic arm being movable between a non-operative position in which is inserted at least partially in said housing, and an operative position in which it is inclined upwards;

a lifting cylinder for actuating said telescopic arm between said operative and non-operative positions, and having a first end pivotally engaged to said frame below the housing, and a second end pivotally engaged to said telescopic arm;

said lifting cylinder being positioned below said telescopic arm, and a bottom part of said housing presenting a vertical opening extending downward towards the outside;

when the telescopic arm is in the operative position the lifting cylinder extending through said vertical opening, and when the telescopic arm is in the non-operative position said lifting cylinder being substantially located outside of said vertical opening, below the frame.

2. A telescopic lifting vehicle as claimed in claim 1 characterized in that it further comprises a front axle and a rear axle connected to the frame below the frame, a transmission and a transfer case connected in series downstream of said engine, and a drive shaft connected below the frame between the transfer case and the two axles, said lifting cylinder being positioned in front of the rear axle, behind the transfer case, above the drive shaft and below the frame.

3. A telescopic lifting vehicle as claimed in claim 1 characterized in that it further comprises means for leveling said operative tool, and a compensating cylinder operatively connected to said leveling means, and having a primary end pivotally engaged to said frame and a secondary end pivotally engaged to said telescopic arm, said compensating cylinder being set side by side to said lifting cylinder below the telescopic arm.

4. A telescopic lifting vehicle as claimed in claim 3 characterized in that said compensating cylinder is set laterally side by side to the lifting cylinder, has equal length to that of the lifting cylinder, and is inserted in said opening when the arm is inserted in the housing.

5. A telescopic lifting vehicle comprising:

a support frame having a central longitudinal axis of development;

a control cab mounted on the frame laterally relative to the longitudinal axis;

an engine mounted on the frame on the opposite side of the longitudinal axis relative to said cab;

said engine and said cab identifying between them a housing open at its top and extending over the entire length of the vehicle along said central longitudinal axis;

a telescopic arm pivotally engaged to a rear portion of said frame according to a horizontal axis perpendicular to the longitudinal axis, able to be inserted at least partially in said housing, and having an operative end connectable to an operative tool;

a lifting cylinder for actuating said telescopic arm, having a first end pivotally engaged to said frame and a second end pivotally engaged to said telescopic arm;

characterized in that said lifting cylinder is positioned below said telescopic arm, and in that through the frame is obtained a vertical opening in correspondence with at least a part of said housing, said lifting cylinder being inserted in said opening and projecting downwardly out of the frame, when the telescopic arm is inserted in said housing;

means for leveling said operative tool, and a compensating cylinder operatively connected to said leveling means, and having a primary end pivotally engaged to said frame and a secondary end pivotally engaged to said telescopic arm, said compensating cylinder being set side by side to said lifting cylinder below the telescopic arm;

wherein said compensating cylinder is set laterally side by side to the lifting cylinder, has equal length to that of the lifting cylinder, and is inserted in said opening when the arm is inserted in the housing; and wherein the first end of the lifting cylinder and the primary end of the compensating cylinder are pivotally engaged to the frame by means of a single first pivot pin, and in that the second end of the lifting cylinder and the secondary end of the compensating cylinder are pivotally engaged to the telescopic arm of a single second pivot pin.

6. A telescopic lifting vehicle comprising:

a support frame having a central longitudinal axis of development;

a control cab mounted on the frame laterally relative to the longitudinal axis;

an engine mounted on the frame on the opposite side of the longitudinal axis relative to said cab;

said engine and said cab identifying between them a housing open at its top and extending over the entire length of the vehicle along said central longitudinal axis;

a telescopic arm pivotally engaged to a rear portion of said frame according to a horizontal axis perpendicular to the longitudinal axis, able to be inserted at least partially in said housing, and having an operative end connectable to an operative tool;

a lifting cylinder for actuating said telescopic arm, having a first end pivotally engaged to said frame and a second end pivotally engaged to said telescopic arm;

characterized in that said lifting cylinder is positioned below said telescopic arm, and in that through the frame is obtained a vertical opening in correspondence with at least a part of said housing, said lifting cylinder being inserted in said opening and projecting downwardly out of the frame, when the telescopic arm is inserted in said housing;

means for leveling said operative tool, and a compensating cylinder operatively connected to said leveling means, and having a primary end pivotally engaged to said frame and a secondary end pivotally engaged to said telescopic arm, said compensating cylinder being set side by side to said lifting cylinder below the telescopic arm; and an element for connecting the jacket of the compensating cylinder to the jacket of the lifting cylinder to support the compensating cylinder when the telescopic arm is lifted, preventing any deformation thereof.

7. A telescopic lifting vehicle as claimed in claim 1 characterized in that the frame comprises two lateral bodies, each defining a side of said housing, a first body whereto is fixed said cab and a second body whereto is fixed said engine, and a plurality of brackets for connecting the two lateral bodies, positioned below said housing.

8. A telescopic lifting vehicle as claimed in claim 7 characterized in that each axle is supported by two of said brackets, and in that said first end of the lifting cylinder is pivotally engaged to one of the brackets supporting the rear axle.

9. A telescopic lifting vehicle as claimed in claim 1 characterized in that it further comprises stabilizing means mounted anteriorly to the frame, said stabilizing means comprising a structure having a latching portion fixed anteriorly to the frame and a supporting portion developing mainly transversely to the frame and integrally connected to said latching portion in its own intermediate portion, said support portion being positioned below said arm, when the latter is inserted in said housing, and two legs positioned at the two sides of the vehicle and each having an inner end pivotally engaged to the supporting portion, and an outer end bearing a stabilizer foot, each leg being able to be actuated between a locked position in which the related foot is set down on the ground, and a maneuvering position in which the related foot is raised off the ground.

10. A telescopic lifting vehicle as claimed in claim 9, characterized in that said support portion has an arcuate shape going partially around the telescopic arm.

11. A telescopic lifting vehicle as claimed in claim 9 characterized in that said latching portion is partly U-shaped and it is fixed to the frame at the two sides of said housing.

12. A telescopic lifting vehicle as claimed in claim 9 characterized in that said latching portion has at least two surfaces for coupling to said frame, a first surface able to be fixed frontally to a front portion of the frame, and a second surface able to be fixed below said front portion.

13. A telescopic lifting vehicle as claimed in claim 9 characterized in that when said feet are in the maneuvering position and said arm is inserted in said housing, the arm is at a height not exceeding that of said feet.

14. A telescopic lifting vehicle as claimed in claim 9 characterized in that said stabilizing means further comprise, for each leg, a hydraulic actuation cylinder having jacket and piston connected one to the support portion of the structure, below the telescopic arm, the other one to the leg, and a valve for feeding the actuating cylinder connected to the cylinder itself in correspondence with its area proximate to the leg.

15. A telescopic lifting vehicle as claimed in claim 1 characterized in that the engine has its axis positioned horizontally and inclined towards a front portion of the longitudinal axis.

* * * * *